US008857209B2

(12) United States Patent
Wang

(10) Patent No.: US 8,857,209 B2
(45) Date of Patent: Oct. 14, 2014

(54) APPARATUS FOR CARRYING/STORING BAKED GOODS AND THE LIKE

(76) Inventor: Junli Wang, Bolingbrook, IL (US)

( * ) Notice: Subject to any disclaimer, the term of this patent is extended or adjusted under 35 U.S.C. 154(b) by 435 days.

(21) Appl. No.: 12/932,688

(22) Filed: Mar. 3, 2011

(65) Prior Publication Data

US 2012/0223087 A1 Sep. 6, 2012

(51) Int. Cl.

| | |
|---|---|
| ***F25D 3/08*** | (2006.01) |
| ***A47G 19/26*** | (2006.01) |
| ***B65D 85/36*** | (2006.01) |
| ***B65D 81/38*** | (2006.01) |
| ***B65D 45/22*** | (2006.01) |

(52) U.S. Cl.

CPC ..... *B65D 81/382* (2013.01); *B65D 45/22* (2013.01); *B65D 85/36* (2013.01); *A47G 19/26* (2013.01); *B65D 2543/00361* (2013.01)

USPC ..... 62/457.1; 62/530; 220/592.2; 220/23.91; 220/23.9

(58) Field of Classification Search

USPC ..... 62/457, 457.1, 457.2, 457.4, 457.8, 62/530; 220/592.2, 4.27, 9.1

See application file for complete search history.

(56) References Cited

U.S. PATENT DOCUMENTS

| | | | | | |
|---|---|---|---|---|---|
| 24,636 | A | * | 7/1859 | Name | 312/236 |
| 1,369,367 | A | * | 2/1921 | Thomson | 220/592.14 |
| 2,379,680 | A | | 7/1945 | Burdick | |
| 2,530,910 | A | * | 11/1950 | Schnabel | 312/322 |
| 2,542,173 | A | * | 2/1951 | Wolf | 312/236 |
| 2,810,276 | A | | 10/1957 | Murray | |
| 3,130,288 | A | | 4/1964 | Monaco et al. | |
| 3,303,964 | A | | 2/1967 | Luker | |
| 3,470,944 | A | * | 10/1969 | Segal | 165/47 |
| 3,511,288 | A | * | 5/1970 | Swett et al. | 206/45.2 |
| 3,590,988 | A | * | 7/1971 | Hollar | 206/776 |
| 3,710,589 | A | * | 1/1973 | Brown et al. | 62/457.2 |
| 3,981,401 | A | | 9/1976 | Blanchard | |
| 4,182,405 | A | * | 1/1980 | Hysen et al. | 165/48.1 |
| 4,197,940 | A | * | 4/1980 | DeRossett | 220/780 |
| 4,206,845 | A | * | 6/1980 | Christian | 206/508 |
| 4,304,106 | A | | 12/1981 | Donnelly | |
| 4,375,862 | A | * | 3/1983 | Kurinsky et al. | 220/293 |
| D284,437 | S | * | 7/1986 | Zieff et al. | D7/542 |
| 4,600,253 | A | * | 7/1986 | Pongsengsook | 312/284 |
| 4,705,163 | A | * | 11/1987 | James | 426/128 |
| 4,733,790 | A | * | 3/1988 | Stein | 220/23.83 |
| 4,741,452 | A | * | 5/1988 | Holzkopf | 220/783 |
| 5,307,647 | A | * | 5/1994 | McClure | 62/371 |
| 5,365,038 | A | * | 11/1994 | Mitsugu | 219/386 |

(Continued)

*Primary Examiner* — Frantz Jules
*Assistant Examiner* — Martha Tadesse
(74) *Attorney, Agent, or Firm* — Christopher J. Scott

(57) ABSTRACT

An apparatus carries and stores foodstuffs in a desired ambient temperature, and comprises a primary tray, a shroud, and a lid. The primary tray comprises an inner support platform portion and an outer shroud-receiving portion. The shroud comprises an inner cover portion and an outer wall portion contiguous with the inner cover portion. The inner cover portion defines a downwardly open matter-receiving space for covering matter supported by the support platform portion. The outer wall portion and the inner cover portion define an upwardly open medium-receiving space for receiving and positioning a heat transfer medium adjacent the matter-receiving space. The lid is seatable upon the shroud for covering the medium-receiving space. A series of fastening mechanisms removably fasten the primary tray to the shroud. A heat transfer medium is receivable in the medium-receiving space for effecting heat transfer intermediate the medium-receiving and matter-receiving spaces.

18 Claims, 15 Drawing Sheets

(56) References Cited

U.S. PATENT DOCUMENTS

| | | | | |
|---|---|---|---|---|
| 5,701,757 | A | 12/1997 | Heverly | |
| 5,913,445 | A * | 6/1999 | Fujii et al. | 220/574 |
| 6,237,765 | B1 * | 5/2001 | Hagen et al. | 206/315.11 |
| 6,244,065 | B1 | 6/2001 | Wuestman | |
| 6,250,104 | B1 | 6/2001 | Bostic | |
| 6,349,559 | B1 * | 2/2002 | Hasanovic | 62/457.7 |
| 6,581,795 | B1 * | 6/2003 | Schulein et al. | 220/212.5 |
| D476,851 | S | 7/2003 | Wuestman | |
| 6,705,109 | B2 * | 3/2004 | DeMars | 62/457.2 |
| 6,840,396 | B2 * | 1/2005 | Wuestman | 220/592.28 |
| D508,378 | S | 8/2005 | Bertulis | |
| 7,051,730 | B2 * | 5/2006 | Lin | 126/246 |
| 7,097,063 | B2 * | 8/2006 | Tucker et al. | 220/366.1 |
| 7,185,760 | B2 * | 3/2007 | Schauer et al. | 206/481 |
| 7,290,677 | B2 | 11/2007 | Wuestman | |
| 8,056,751 | B2 * | 11/2011 | Vovan | 220/300 |
| 8,065,888 | B2 * | 11/2011 | Rogers | 62/457.6 |
| 2003/0172671 | A1 | 9/2003 | DeMars | |
| 2004/0194495 | A1 | 10/2004 | Gleason et al. | |
| 2005/0000847 | A1 * | 1/2005 | McNeeley | 206/527 |
| 2005/0077303 | A1 * | 4/2005 | Minner et al. | 220/574 |
| 2005/0218146 | A1 | 10/2005 | Thissen | |
| 2005/0269434 | A1 * | 12/2005 | Starr | 241/92 |
| 2006/0117787 | A1 | 6/2006 | Martino | |
| 2006/0179716 | A1 * | 8/2006 | Maniscalco et al. | 47/81 |
| 2007/0261431 | A1 | 11/2007 | Cohen et al. | |
| 2009/0077997 | A1 | 3/2009 | Lowrey et al. | |
| 2009/0126394 | A1 * | 5/2009 | Krog | 62/399 |
| 2009/0191317 | A1 * | 7/2009 | Lin | 426/119 |
| 2010/0200583 | A1 * | 8/2010 | Curtin et al. | 220/4.27 |
| 2010/0251902 | A1 * | 10/2010 | Schandel et al. | 99/348 |
| 2011/0186585 | A1 * | 8/2011 | Lu | 220/575 |
| 2011/0260023 | A1 * | 10/2011 | Braun | 248/220.21 |
| 2013/0008909 | A1 * | 1/2013 | Terracciano | 220/592.2 |

* cited by examiner

APPARATUS FOR CARRYING/STORING BAKED GOODS AND THE LIKE

BACKGROUND OF THE INVENTION

1. Field of the Invention

The present invention relates generally to an apparatus for carrying food. More particularly, the present invention relates to a container apparatus primarily for carrying baked goods such as cakes, cupcakes, pies, and other baked goods.

2. Brief Description of the Prior Art

The prior art relating to various means for food containment is old and well-developed. Many types of food require a relatively reduced temperature so as to maintain the food in a more delectable state, and thus the prior art has more particularly addressed food containment means for maintaining foodstuffs in a relatively cool or reduced temperature environment. A relatively early disclosure describing this type of food containment means may be seen by inspecting U.S. Pat. No. 24,636, issued to Smith in 1859.

The Smith patent discloses a Butter Dish or Butter Cooler. The Smith apparatus essentially provides a butter-supportive plate, which plate is covered by a sealed, double-walled lid for receiving ice and which plate is positioned over an ice-retaining bowl. The butter or similar other food item positioned upon the plate may thus be positioned centrally relative to ice-filled compartments for maintaining the butter or similar other food item in a chilled state.

Further, U.S. Pat. No. 3,710,589, issued to Brown et al., discloses a Bowl Assembly for Chilling Salads or the Like. The bowl assembly comprises a first bowl in which a salad or the like is to be placed, and a second bowl within which the first bowl is at least partially received, in a manner leaving a space between the bowls for holding water which is to be frozen to maintain the salad in chilled condition, and with interfitting detents being provided on the two bowls for releasably retaining them in assembled relation. The lower bowl may also function when desired as a cover for the main bowl, or alternatively a separate cover may be provided.

U.S. Pat. No. 4,206,845, issued to Christian, discloses a Food Container. The Christian food container is suited for use in carry out food service having a base and cover. Each container portion is of tapered construction to permit stacking upon itself for storage and each has stop members formed thereon to determine stack height. Catch structure is formed on the cover which interlocks with resilient lip structure formed around the upper periphery of the base to detachably lock the container and base in an assembled state.

The container base forms a shallow hollow of sufficient depth to prevent spillage, but is sufficiently flat to permit use as a plate which can be eaten upon with knife and fork. The resilient lip structure defines, when interlocked with the cover, vents which provide air circulation in the closed container to prevent condensation therein. Interfitting structure is formed on the top of the cover and the bottom of the base for retaining one assembled container stably stacked on another with food contained therein. The container portions are preferably made of inexpensive heat insulative material to keep food warm and also be disposable.

U.S. Pat. No. 5,307,647, issued to McClure, discloses a Food Serving Refrigerant Device. The device is a conveniently stackable, storable, transportable and displayable food service device utilizing temperature maintaining refrigerant units to provide a relatively convenient and inexpensive method of refrigerating, transporting and serving food is provided. The temperature maintaining refrigerant units are disposed within a refrigerant cavity configured in a base of the device in interfitted puzzle-like fashion. The refrigerant units are interchangeable and may be easily stored and replaced after their temperature maintaining capacity has been exhausted.

A food tray is designed to removably interfit with the base of the device such that the food surface of the tray is supported in spaced relationship above the refrigerant units when the food tray and base are in nested relationship. A cover is provided to fit in supporting relationship with the food tray. The cover includes a recess portion to nestingly accept the exterior of the base to elevate the base and food tray for display and service purposes. The cover also receives the base of another like container so that a stack of refrigerated devices may be easily transported and/or stored. The cover also includes a channel to prevent condensation from dripping onto and spoiling the food servings supported on the tray.

U.S. Pat. No. 5,701,757, issued to Heverly, discloses a Portable Refrigerator Food Container. The portable food refrigeration system or container facilitates cooling of food when a refrigerator is unavailable thereby preventing the food from melting and becoming unappealing. The device includes an outer pan formed to receive a frozen gel pack on the bottom surface, and an inner pan removably positioned within the outer pan juxtaposed the frozen gel pack where the inner pan creates a seal with the outer pan preventing the escape of cooled air from between the pans.

United States Patent Application Publication No. 2005/0218146, authored by Thissen, discloses a Food and Beverage Storage and Serving Vessel Comprising an Integral Phase Change Material. The food and beverage storage and serving vessel comprises an inner container, an outer container, and a removable lid. The outer container has a hollow chamber that extends through a bottom wall and a side wall of the outer container. The chamber is filled with a phase change material that stays cold for an extended period of time when chilled, or stays hot for an extended period of time when heated. The inner container is removably assembled into the outer container, where surface contact between the inner container and outer container transfers the cold/heat of the phase change material to a food or beverage contained in the inner container.

United States Patent Application Publication No. 2006/0117787, authored by Martino, discloses a Portable Food Container with Refrigerating System. This publication describes an inexpensive portable food container capable of keeping food cold and fresh for several hours. The apparatus comprises two parts: a main compartment consisting of rigid sidewalls and a bottom, and a cover removable from said main compartment, wherein said sidewalls, said bottom and said cover contain a refrigerant substance that remains cold for several hours.

The apparatus is designated to be placed inside a fridge (or any similar device) until the refrigerant substance gets cold or frozen. Afterwards, users can place food inside the main compartment, close it with the cover and carry the apparatus with them for later consumption of fresh food. The apparatus can be carried inside a handbag, briefcase, backpack, or any similar device.

United States Patent Application Publication No. 2010/0200583, authored by Curtin et al. discloses a Baked Goods Carrier. The Curtin et al. baked goods carrier essentially functions to cover and transport baked goods or other food products and comprises a base for supporting a pie, cake, cupcakes, or other baked goods. A cover is configured to be attached to the base to generally enclose the carrier, thereby protecting the baked goods for transport or storage. The cover is formed with a flexible membrane that makes it collapsible for more convenient storage.

From a consideration of the foregoing, it will be noted that the prior art perceives a need for an apparatus for carrying and storing foodstuffs in a desired ambient temperature, and comprises a primary tray, a shroud, and a lid wherein the primary tray comprises an inner support platform portion and an outer shroud-receiving portion, and wherein the shroud comprises a integral, W-shaped longitudinal cross-section defining an upwardly open medium-receiving space, and a downwardly open matter-receiving space. In this last regard, the prior art perceives a need for such a foodstuff carrier apparatus as summarized in more detail hereinafter.

SUMMARY OF THE INVENTION

To achieve these and other readily apparent objectives, the present invention essentially discloses an apparatus for carrying and storing foodstuffs (e.g. a cake, other similar baked goods, or other temperature-dependent foods) in a desired ambient temperature. The apparatus according to the present invention preferably comprises, in combination, a circular, primary tray structure; a circular, shroud structure; and an annular lid structure. Certain fastening means are cooperably associated with the primary tray structure and shroud structure for removably fastening the primary tray structure to the shroud structure.

The primary tray structure preferably comprises a centralized or inner support platform portion and a radially outward or outer shroud-receiving or shroud-opposing portion. The outer shroud-receiving portion preferably comprises first and second or inner and outer concentric ridge-receiving or shroud-opposing grooves. The grooves essentially function to catch and collect condensation that may form on surfaces of the shroud structure.

The outer groove of the primary tray structure is preferably outfitted with a series of circumferentially spaced mechanisms for fastening the outer groove of the outer shroud-receiving portion to the shroud structure. In this regard, the fastening means may be preferably exemplified by tabs having male protrusions pivotable about pivot bars having pivot axes substantially tangent to portions of the outer groove.

The shroud structure preferably comprises a roughly W-shaped longitudinal cross-section. The center, inverted V-section of the "W" is exaggerated in width and comprises a substantially horizontal plateau or center section for defining a downwardly open matter-receiving space. The outer upright V-sections of the "W" are relatively abbreviated in width and form a double wall. The double wall comprises opposed inner and upright sections, which sections are concentric and substantially or nearly parallel to one another for defining an upwardly open medium-receiving space.

The inner upright section defines a cylindrical, central portion and together with the contiguous center section may be said to define the inner cover portion. The shroud structure further comprises an outer wall portion contiguous with the inner cover portion, and comprises a groove-opposing bottom portion. Extending downwardly from the bottom portion are concentric first and second or inner and outer ridges.

The first or inner ridge is received by the first or inner groove of the primary tray structure, and the second or outer ridge is received by the second or outer groove of the primary tray structure. The shroud structure further and preferably comprises circumferentially spaced female structure for receiving the male protrusions of the tabs and a user's finger for pulling/pivoting the tabs.

The female structures are essentially cavities formed in the double wall at the outer upright section thereof. The female structures function to simultaneously receive and conceal the male structures when the fastening means fasten the primary tray structure to the shroud structure. The fastening means thus function to interconnect the outer groove to the outer wall portion for bearing a load inherent to the primary tray structure and matter-received thereupon via the fastening means.

The inner cover portion defines the matter-receiving space and essentially functions to cover matter (e.g. foodstuffs and/or foodstuff-supportive secondary tray structures) otherwise supported by the support platform portion. The inner cover portion further preferably comprises an upwardly extending handle. The upwardly extending handle essentially functions to enable a user to more easily carry the shroud structure.

The outer wall portion or outer upright section of the shroud structure has an inner wall surface. Together, the outer cover surface and the inner wall surface may be said to define the medium-receiving space. The medium-receiving space essentially functions to receive and position a heat transfer medium (e.g. (1) ice or similar other relatively low temperature material or (2) boiled water or similar other relatively high temperature material (not specifically shown)) for transferring heat energy intermediate the medium-receiving space and the matter-receiving space.

The annular lid structure is seatable upon the shroud structure for covering the medium-receiving space. The lid structure comprises an inner lid surface. The inner wall surface, inner lid surface, and outer cover surface together define a heat transfer sourcing compartment when the lid structure is seated upon the shroud structure. The lid structure, being preferably annular, thus comprises a handle-receiving aperture.

The upwardly extending handle is extended through the aperture of the annular lid structure for enabling the user to simultaneously carry the lid and shroud structures. Notably, the sourcing compartment has a longitudinal cross-section, which longitudinal cross-section may be said to comprise opposed inverted L-shaped portions radially opposite the aperture for maximizing the heat transfer area surrounding the matter-receiving space.

Certain secondary tray structures may preferably be stacked and received within the primary matter-receiving space, and each comprises a series of tray feet. The tray feet are preferably received in a series of matter-receiving depressions formed in the support platform portion. The matter-receiving depressions thus essentially function to receive matter such as the tray feet in secondary matter-receiving space(s) extending downwardly relative to the primary matter-receiving space.

The reader is directed to consider the drawings in more detail as supportive of the foregoing summarized descriptions. In this regard, it is contemplated that other features of the present invention will become more evident from a consideration of the following brief descriptions of patent drawings.

DETAILED DESCRIPTION OF THE PREFERRED EMBODIMENT

Figure 1:
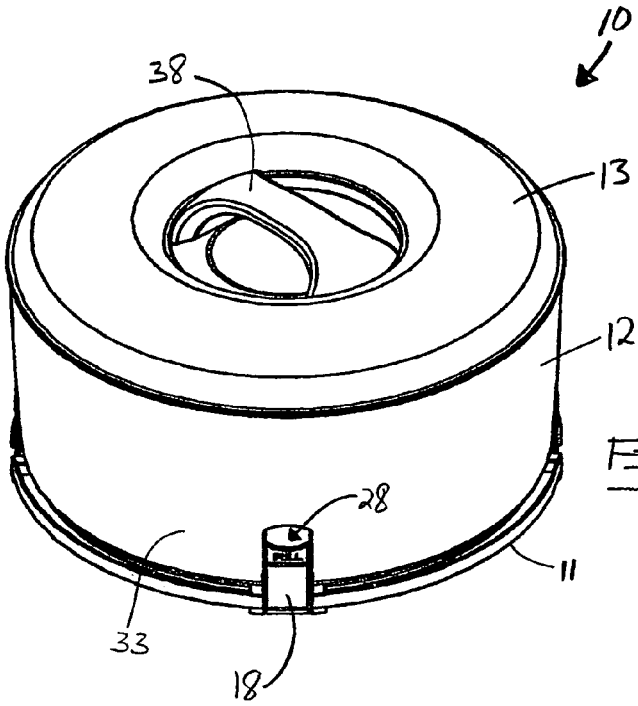
FIG. 1 is a first top perspective view of the apparatus for carrying baked goods and the like according to the present invention showing the tray-based fastening means in a closed position for removably fastening the primary tray structure to the shroud structure.
Figure 2:
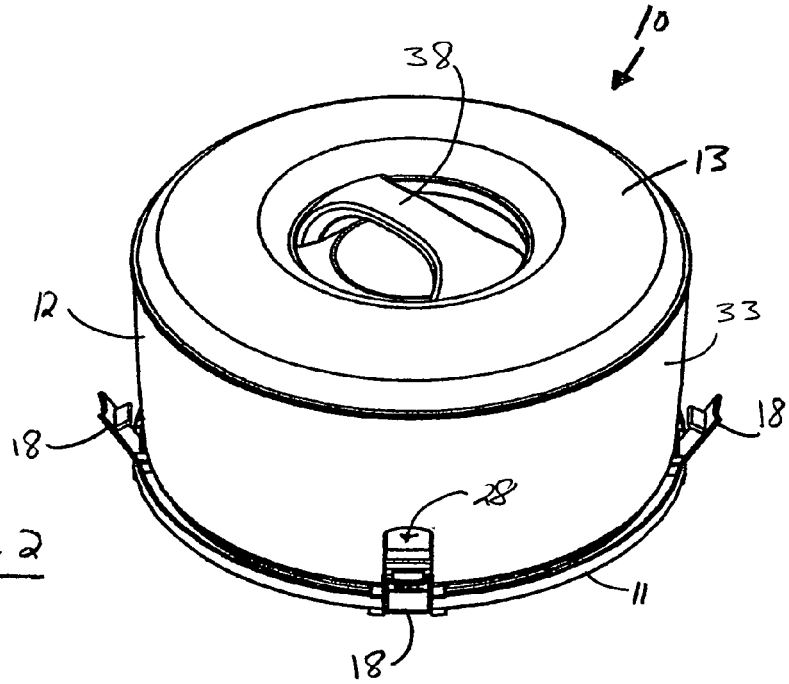
FIG. 2 is a second top perspective view of the apparatus for carrying baked goods and the like according to the present invention showing the tray-based fastening means in an open position for releasing the primary tray structure from the shroud structure.
Figure 3:
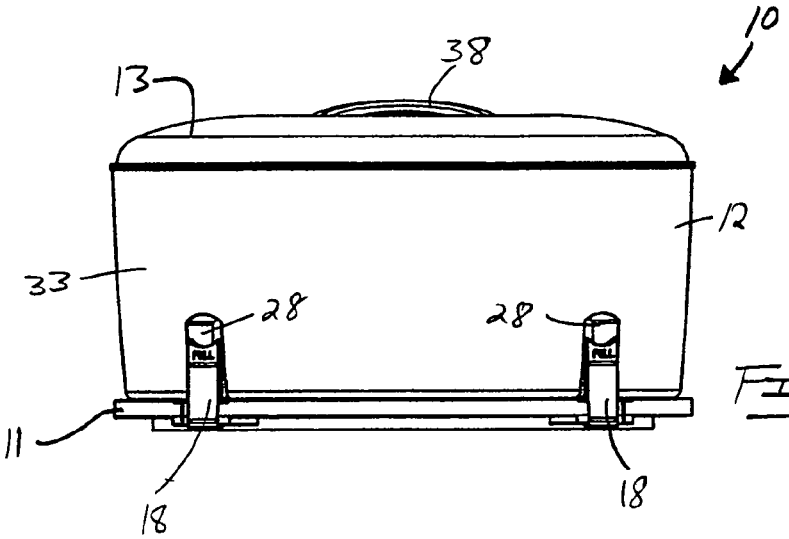
FIG. 3 is a first side elevational view of the apparatus for carrying baked goods and the like according to the present invention showing the tray-based fastening means in a closed position for removably fastening the primary tray structure to the shroud structure.
Figure 4:
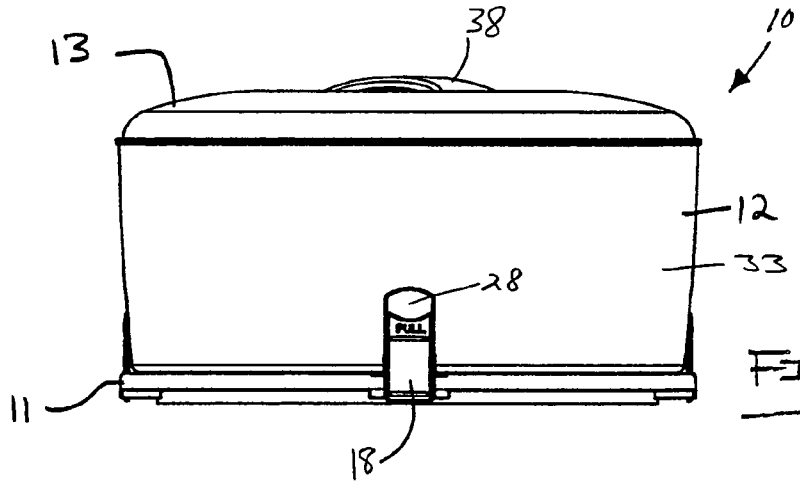
FIG. 4 is a second side elevational view of the apparatus otherwise depicted in FIG. 3, the apparatus depicted in FIG. 4 being rotated 45 degrees relative to the apparatus depicted in FIG. 3.
Figure 5:
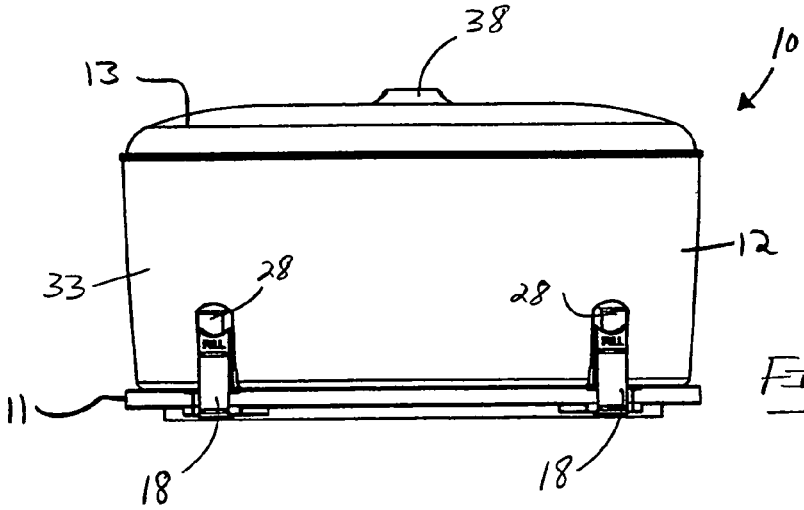
FIG. 5 is a third side elevational view of the apparatus otherwise depicted in FIG. 3, the apparatus depicted in FIG. 5 being rotated 90 degrees relative to the apparatus depicted in FIG. 3.
Figure 6:
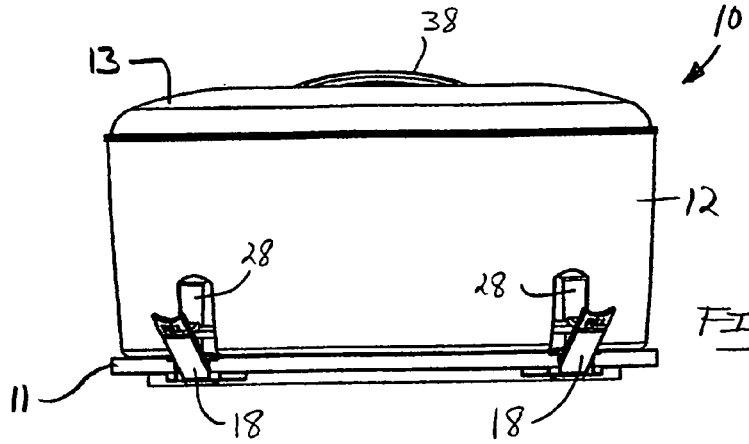
FIG. 6 is a first side elevational view of the apparatus for carrying baked goods and the like according to the present invention showing the tray-based fastening means in an open position for releasing the primary tray structure from the shroud structure.
Figure 7:
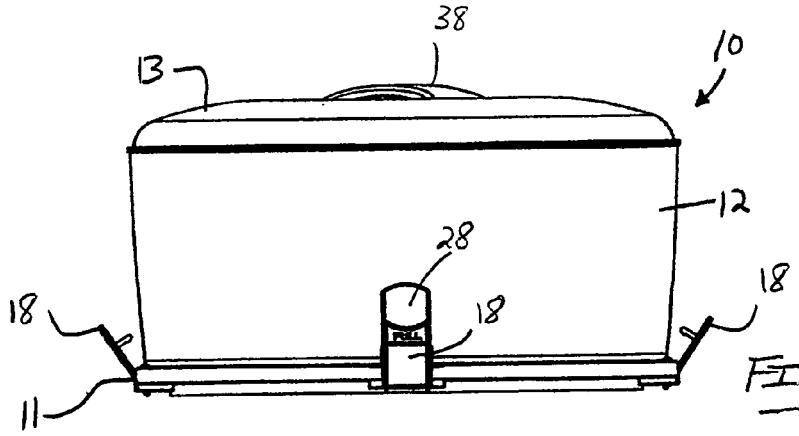
FIG. 7 is a second side elevational view of the apparatus otherwise depicted in FIG. 6, the apparatus depicted in FIG. 7 being rotated 45 degrees relative to the apparatus depicted in FIG. 6.
Figure 8:
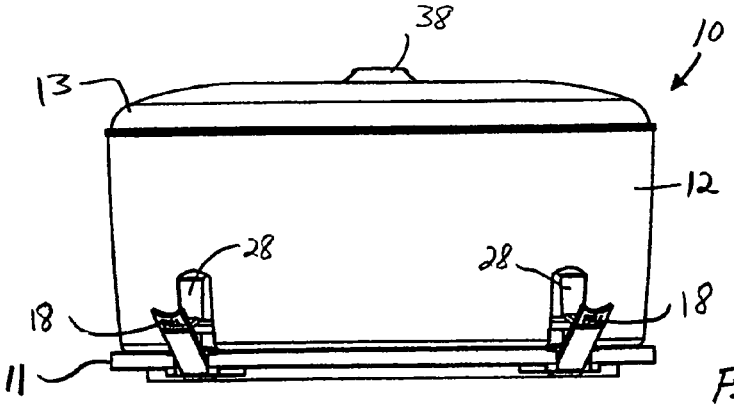
FIG. 8 is a third side elevational view of the apparatus otherwise depicted in FIG. 6, the apparatus depicted in FIG. 8 being rotated 90 degrees relative to the apparatus depicted in FIG. 6.
Figure 9:
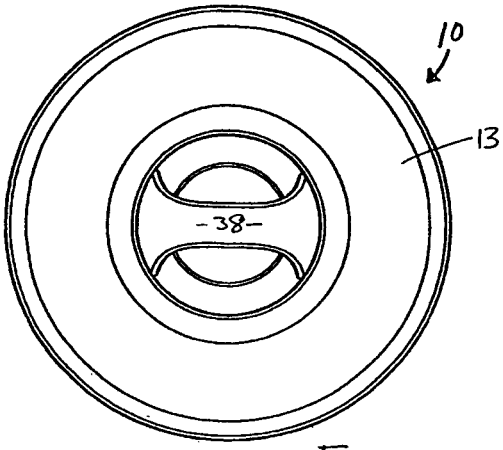
FIG. 9 is a top plan view of the apparatus for carrying baked goods and the like according to the present invention depicting concealed tray-based fastening means while in the closed position for removably fastening the primary tray structure to the shroud structure.
Figure 10:
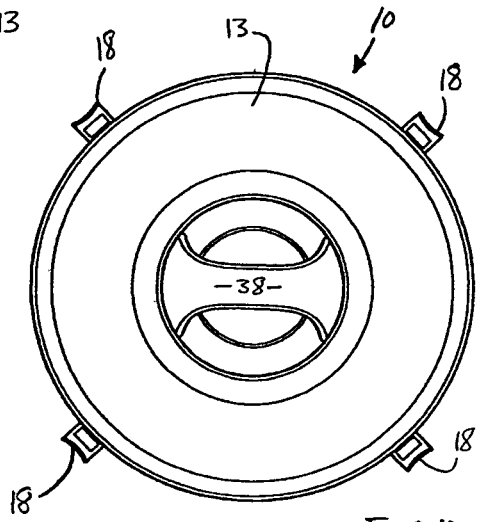
FIG. 10 is a top plan view of the apparatus for carrying baked goods and the like according to the present invention depicting the tray-based fastening means in the position for releasing the primary tray structure from the shroud structure.
Figure 11:
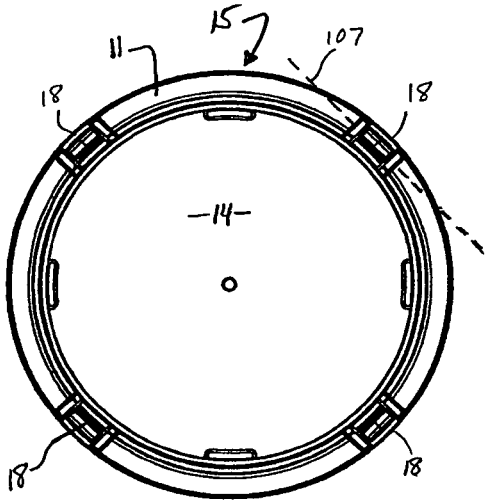
FIG. 11 is a bottom plan view of the apparatus for carrying baked goods and the like according to the present invention depicting concealed tray-based fastening means while in the closed position for removably fastening the primary tray structure to the shroud structure.
Figure 12:
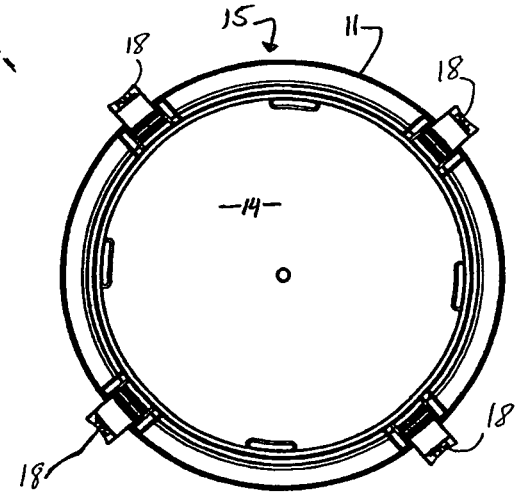
FIG. 12 is a bottom plan view of the apparatus for carrying baked goods and the like according to the present invention depicting the tray-based fastening means in the position for releasing the primary tray structure from the shroud structure.
Figure 13:
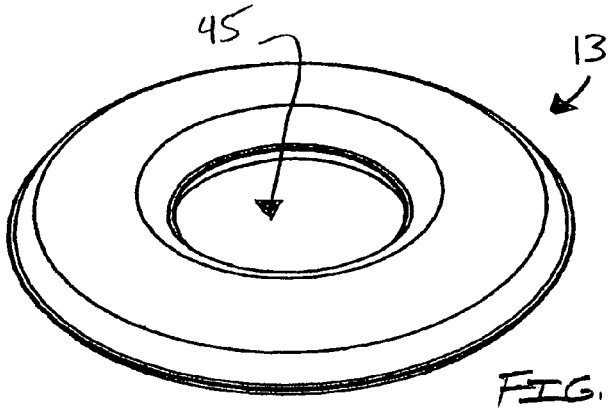
FIG. 13 is a top perspective view of the annular lid structure according to the present invention showing a centralized handle-receiving aperture.
Figure 14:
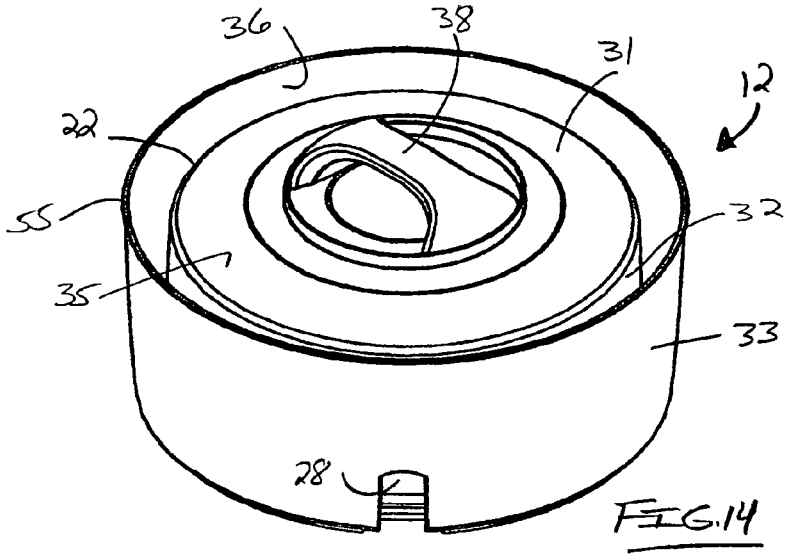
FIG. 14 is a top perspective view of the shroud structure according to the present invention showing an upper centralized handle, an inner cover portion from which the handle upwardly extends, and an outer wall portion concentric with the inner cover portion.
Figure 15:
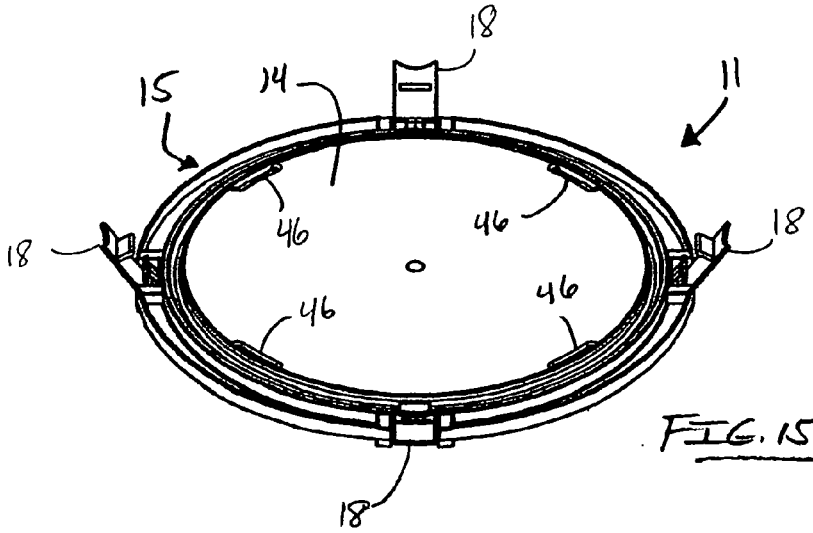
FIG. 15 is a top perspective view of the primary tray structure according to the present invention showing an inner support platform portion, outer concentric grooves, and a series of circumferentially spaced fastening mechanisms for engaging the outer wall portion of the shroud structure.
Figure 16:
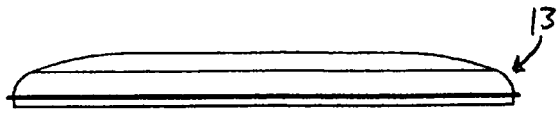
FIG. 16 is a side elevational view of the annular lid structure according to the present invention showing outer and upper sloped surfacing.
Figure 17:
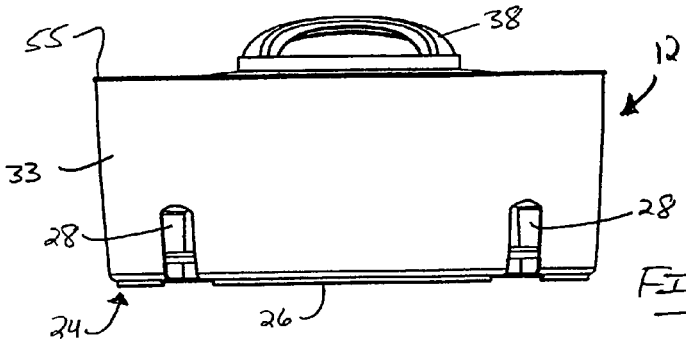
FIG. 17 is a side elevational view of the shroud structure according to the present invention showing an upper centralized handle and an outer wall portion, which wall portion comprises two circumferentially spaced female structure for receiving male structure of the fastening mechanism(s) associated with the primary tray structure.
Figure 18:
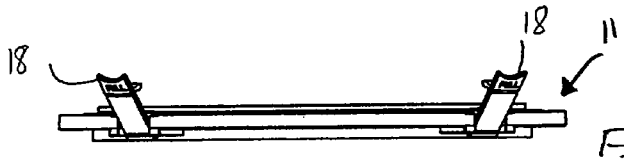
FIG. 18 is a side elevational view of the primary tray structure according to the present invention showing two circumferentially spaced fastening mechanisms for engaging the female structures formed in the outer wall portion of the shroud structure.
Figure 19:
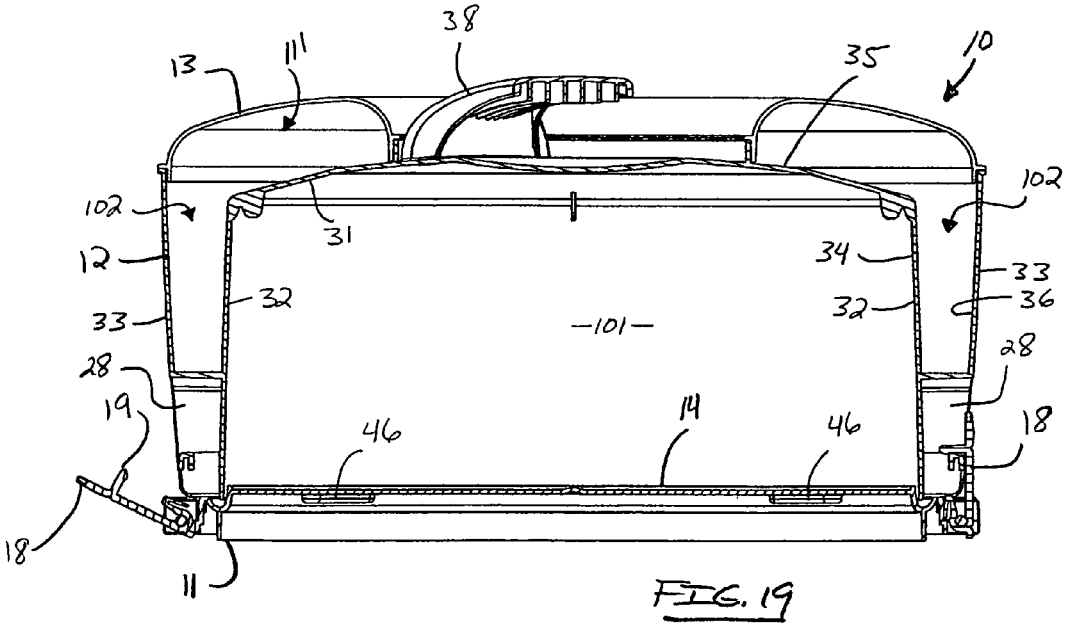
FIG. 19 is an enlarged longitudinal sectional view of the apparatus for carrying baked goods and the like according to the present invention as sectioned obliquely relative to the axis of the handle showing an inner matter-receiving space or compartment, an outer medium-receiving space or compartment, a left tray-shroud fastening mechanism in an open position and a right tray-to-shroud fastening mechanism in a closed position.
Figure 20:
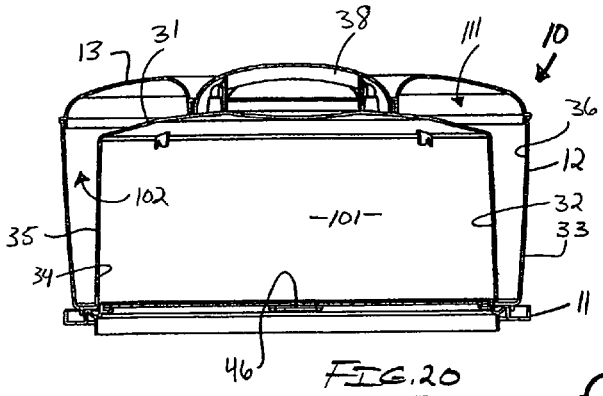
FIG. 20 is a first longitudinal sectional view of the apparatus for carrying baked goods and the like according to the present invention as sectioned through the axis of the handle showing an empty inner matter-receiving space or compartment and an empty outer medium-receiving space or compartment.
Figure 21:
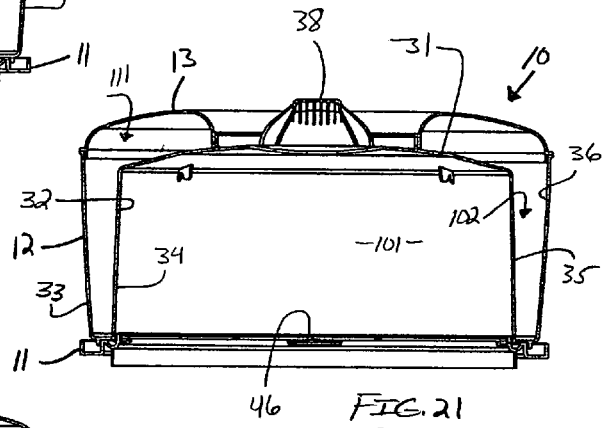
FIG. 21 is a second longitudinal sectional view of the apparatus for carrying baked goods and the like according to the present invention as sectioned orthogonally relative to the axis of the handle showing an inner empty matter-receiving space or compartment and an empty outer medium-receiving space or compartment.
Figure 22:
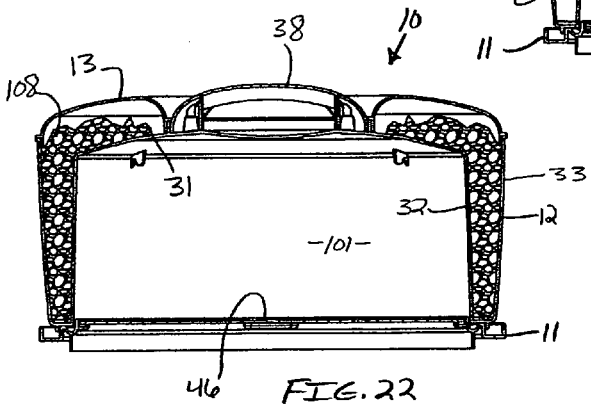
FIG. 22 is a third longitudinal sectional view of the apparatus for carrying baked goods and the like according to the present invention as sectioned through the axis of the handle showing an empty inner matter-receiving space or compartment and an ice-filled outer medium-receiving space or compartment.
Figure 23:
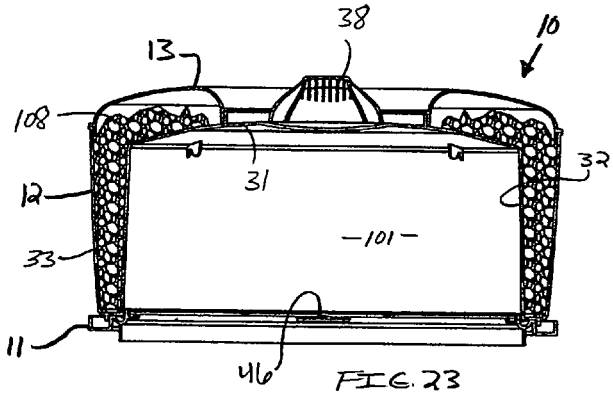
FIG. 23 is a fourth longitudinal sectional view of the apparatus for carrying baked goods and the like according to the present invention as sectioned orthogonally relative to the axis of the handle showing an empty inner matter-receiving space or compartment and an ice-filled outer medium-receiving space or compartment.

Referring now to the drawings with more specificity, the preferred embodiment of the present invention concerns an apparatus 10 for carrying and storing foodstuffs (e.g. a cake, other similar baked goods, or other temperature-dependent foods) in a desired ambient temperature. The apparatus 10 according to the present invention is preferably constructed from polymeric material(s) and comprises, in combination, a circular, primary tray structure 11; a circular, shroud structure 12; and an annular lid structure 13. Certain fastening means are cooperably associated with the primary tray structure 11 and shroud structure 12 for removably fastening the primary tray structure 11 to the shroud structure 12 as described and exemplified in more detail hereinafter.

The primary tray structure 11 preferably comprises a centralized or inner support platform portion as at 14 and a radially outward or outer shroud-receiving or shroud-opposing portion as depicted and referenced at 15. It will be seen from an inspection of the various figures that the outer shroud-receiving portion 15 preferably comprises first and second or inner and outer concentric ridge-receiving or shroud-opposing grooves 16 and 17. The first or inner groove is depicted and referenced at 16, and the second or outer groove is depicted and referenced at 17. The grooves essentially function to catch and collect condensation 105 that may form on surfaces of the shroud structure 12. Pooled condensation is depicted and referenced at 106.

The outer groove 17 of the primary tray structure 11 is preferably outfitted with a series of circumferentially spaced mechanisms for fastening the outer groove 17 of the outer shroud-receiving portion 15 to the shroud structure 12. In this regard, the fastening means may be preferably exemplified by tabs 18 having male protrusions 19 pivotable about pivot bars 20 having pivot axes 100 substantially tangent (as at 107) to portions of the outer groove 17. It will be seen that the tabs 18 comprise a tab extension portion 21 which extends substantially orthogonal to the male protrusion 19.

The shroud structure 12 preferably comprises a roughly W-shaped longitudinal cross-section. In this regard, the reader will note that the center, inverted V-section of the "W" is exaggerated in width and comprises a substantially horizontal plateau or center section as at 31 for defining a downwardly open matter-receiving space as at 101. The outer upright V-sections of the "W" are relatively abbreviated in width and form a double wall. The double wall comprises opposed inner and upright sections (as at 32 and 33, respectively), which sections 32 and 33 are concentric and substantially or nearly parallel to one another for defining an upwardly open medium-receiving space as at 102.

The inner upright section 32 defines a cylindrical, central portion and together with the contiguous center section 31 may be said to define the inner cover portion 22. The shroud structure 12 further comprises an outer wall portion 23 contiguous with the inner cover portion 22, which outer wall portion may be said to comprise contiguous section(s) 33 and 24. Section 24 may be said to be a groove-engaging bottom portion or section. Extending downwardly from the bottom portion 24 are concentric first and second or inner and outer ridges as at 25 and 26, respectively.

The first or inner ridge 25 is received by the first or inner groove 16 of the primary tray structure 11, and the second or outer ridge 26 is received by the second or outer groove 17 of the primary tray structure 11. The shroud structure 12 further and preferably comprises circumferentially spaced female structure 28 for receiving the male protrusions 19 of tabs 18 and a user's finger (for pulling/pivoting the tabs 18).

More particularly, the circular primary tray structure 11 preferably comprises a circular inner support platform portion as at 14, and a circular outer shroud-receiving portion as at 15. The circular outer shroud-receiving portion 15 has a circular, radially inner groove as at 16, and a circular, radially outer groove as at 17. The radially inner groove 16 has an inner groove trough as at 66, and the radially outer groove 17 has an outer groove trough as at 67. The inner groove trough 66 is preferably elevated relative to the outer groove trough 67 by a height difference as at 120.

The circular shroud structure 12 preferably comprises an inner cover portion as at 22, and an outer wall portion as at 23 contiguous with the inner cover portion 22. The outer wall portion 23 has a circular, radially inner ridge as at 25, and a circular, radially outer ridge as at 26 at a bottom portion thereof. The radially inner and outer grooves 16 and 17 of the outer shroud-receiving portion 15 respectively receive the radially inner and outer ridges 25 and 26.

The female structures 28 are essentially cavities formed in the double wall at the outer upright section 33. It will be further seen that the male structure or protrusions 19 comprise a lip as at 29, which lips 29 are retained by lip-retaining structures 30 adjacent the mouths of the females structures 28. The female structures 28 thus simultaneously receive and conceal the male structures 19 when the fastening means fasten the primary tray structure 11 to the shroud structure 12. The fastening means thus function to interconnect the outer groove 17 to the outer wall portion 23 for bearing a load inherent to the primary tray structure 11 and matter-received (e.g. foodstuffs and/or secondary tray structures) thereupon via the fastening means.

The inner cover portion 22 as defined by sections 32 and 31 comprises an inner cover surface as at 34 and an outer cover surface as at 35. The inner cover surface 34 may be said to define the matter-receiving space 101 and essentially functions to cover matter (e.g. foodstuffs and/or foodstuff-supportive secondary tray structures as at 41, 42, and 43) otherwise supported by the support platform portion 14. The inner cover portion 22 further preferably comprises an upwardly extending handle as at 38. The upwardly extending handle 38 essentially functions to enable a user to more easily carry the shroud structure 12.

The outer wall portion or outer upright section 33 of the shroud structure 12 has an inner wall surface as at 36. Together, the outer cover surface 35 and the inner wall surface 36 may be said to define the medium-receiving space 102. The medium-receiving space 102 essentially functions to receive and position a heat transfer medium (e.g. (1) ice 108 or similar other relatively low temperature material (e.g. chilled gel pack(s)), or (2) boiled water or similar other relatively high temperature material (e.g. heated gel pack(s) not specifically shown) for transferring heat energy 110 intermediate the medium-receiving space 102 and the matter-receiving space 101.

The annular lid structure 13 is seatable upon the shroud structure 12 for covering the medium-receiving space 102. The lid structure 13 comprises an inner lid surface as at 39. The inner wall surface 36, inner lid surface 39, and outer cover surface 35 together define a heat transfer sourcing compartment 111 when the lid structure 13 is seated upon the shroud structure 12. The lid structure 13, being preferably annular, thus comprises a handle-receiving aperture 45.

The upwardly extending handle 38 is extendable through the aperture 45 of the annular lid structure 13 for enabling the user to simultaneously carry the lid and shroud structures 13 and 12, respectively. Notably, the sourcing compartment 111 has a longitudinal cross-section, which longitudinal cross-section may be said to comprise opposed inverted L-shaped portions 112 radially opposite the aperture 45 for maximizing the heat transfer area surrounding the matter-receiving space 102.

Figure 36:
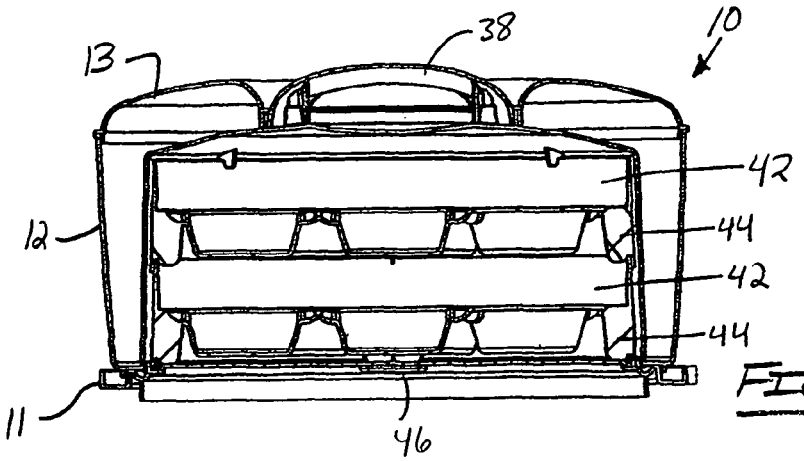
FIG. 36 is a longitudinal sectional view of the apparatus for carrying baked goods and the like according to the present invention as sectioned through the axis of the handle showing a secondary tray-filled, inner matter-receiving space or compartment and an empty outer medium-receiving space or compartment, the inner matter-receiving space receiving two stacked second secondary tray structures as otherwise depicted in FIGS. 32 and 33.
Figure 37:
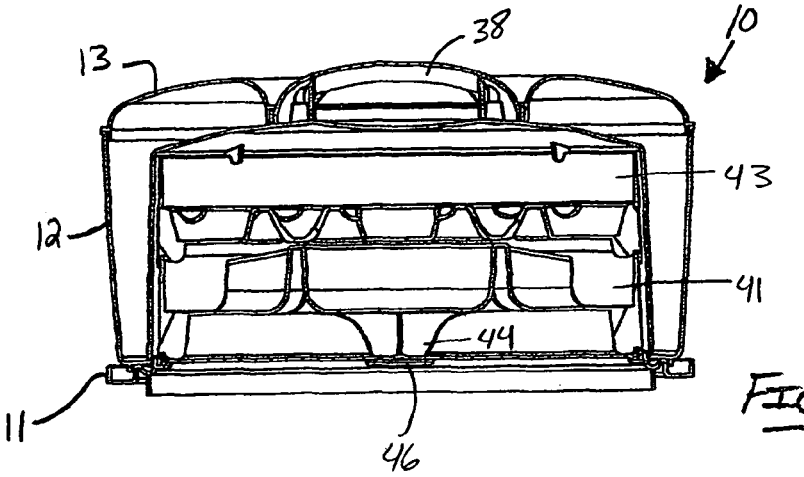
FIG. 37 is a longitudinal sectional view of the apparatus for carrying baked goods and the like according to the present invention as sectioned through the axis of the handle showing a secondary tray-filled, inner matter-receiving space or compartment and an empty outer medium-receiving space or compartment, the inner matter-receiving space receiving the first secondary tray structure as otherwise depicted in FIGS. 30 and 31 and the third secondary tray structure as otherwise depicted in FIGS. 34 and 35 stacked upon the first secondary tray structure.
Figure 38:
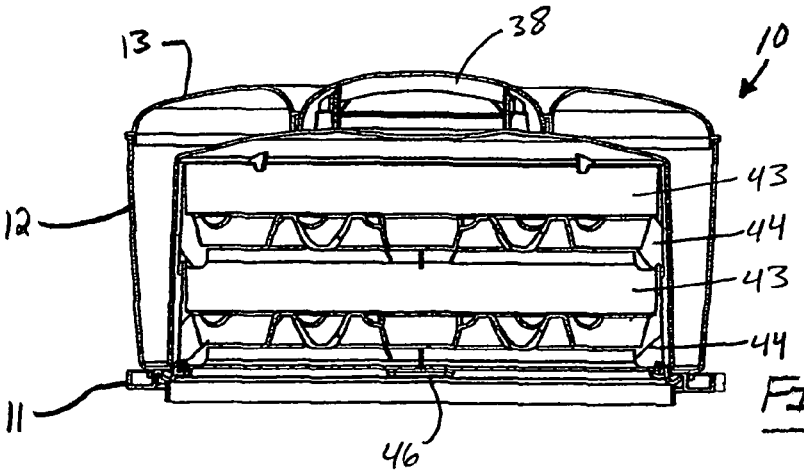
FIG. 38 is a longitudinal sectional view of the apparatus for carrying baked goods and the like according to the present invention as sectioned through the axis of the handle showing a secondary tray-filled, inner matter-receiving space or compartment and an empty outer medium-receiving space or compartment, the inner matter-receiving space receiving two stacked third secondary tray structures as otherwise depicted in FIGS. 34 and 35.

In this last regard, it will be seen that heat energy 110 may be directed both upwardly toward the lid structure 13 and outwardly toward the outer wall section 33 for maintaining matter received in the matter-receiving space 102 in a desired ambient temperature. In addition to foodstuffs, it is contemplated that secondary tray structures (as exemplified by secondary tray structures 41, 42, and 43) may be (stacked and) received in the matter-receiving space 102 as generally depicted in FIGS. 36-38.

Figure 24:
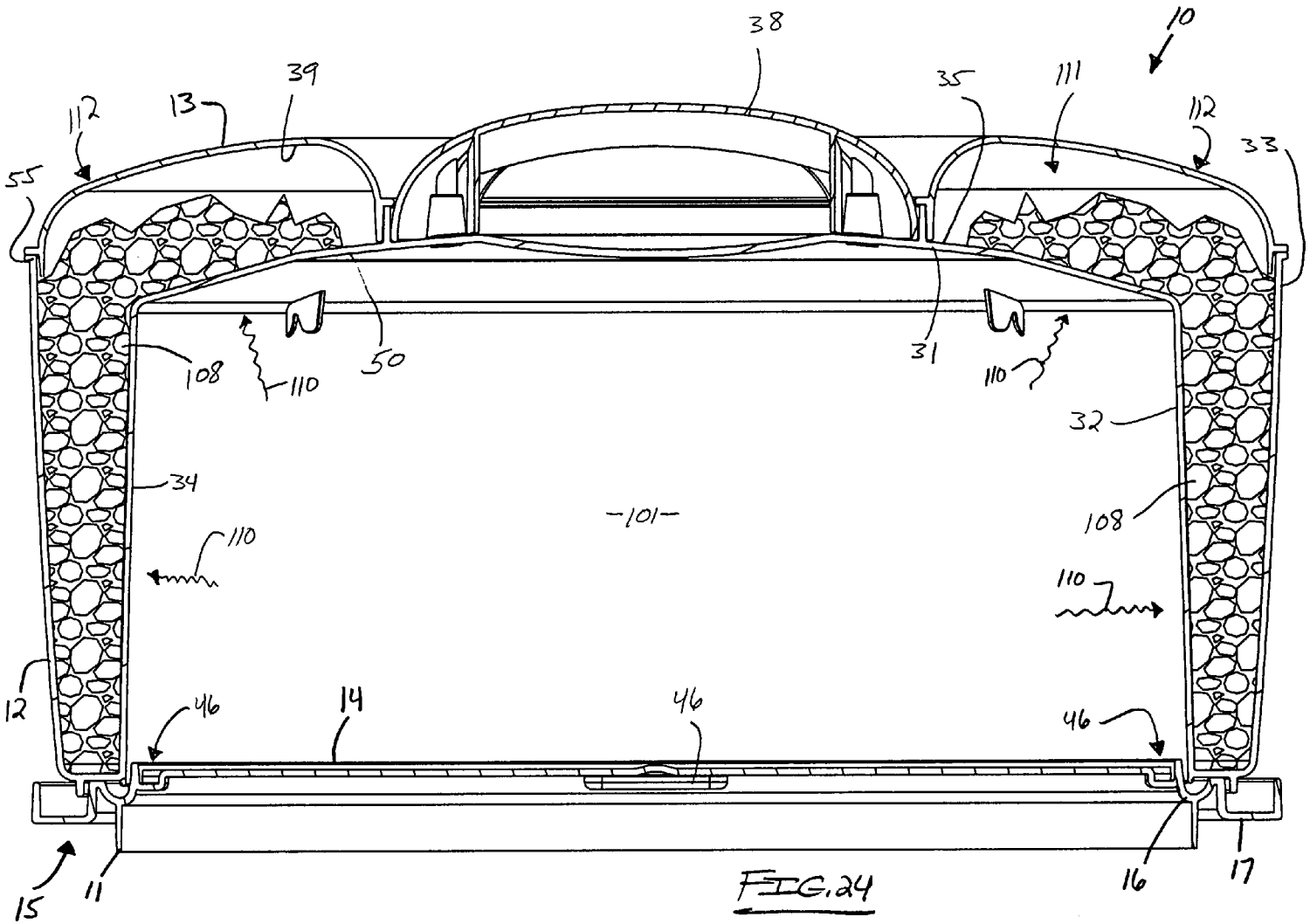
FIG. 24 is an enlarged longitudinal sectional view of the apparatus for carrying baked goods and the like according to the present invention as sectioned through the axis of the handle showing an empty inner matter-receiving space or compartment and an ice-filled outer medium-receiving space or compartment.
Figure 25:
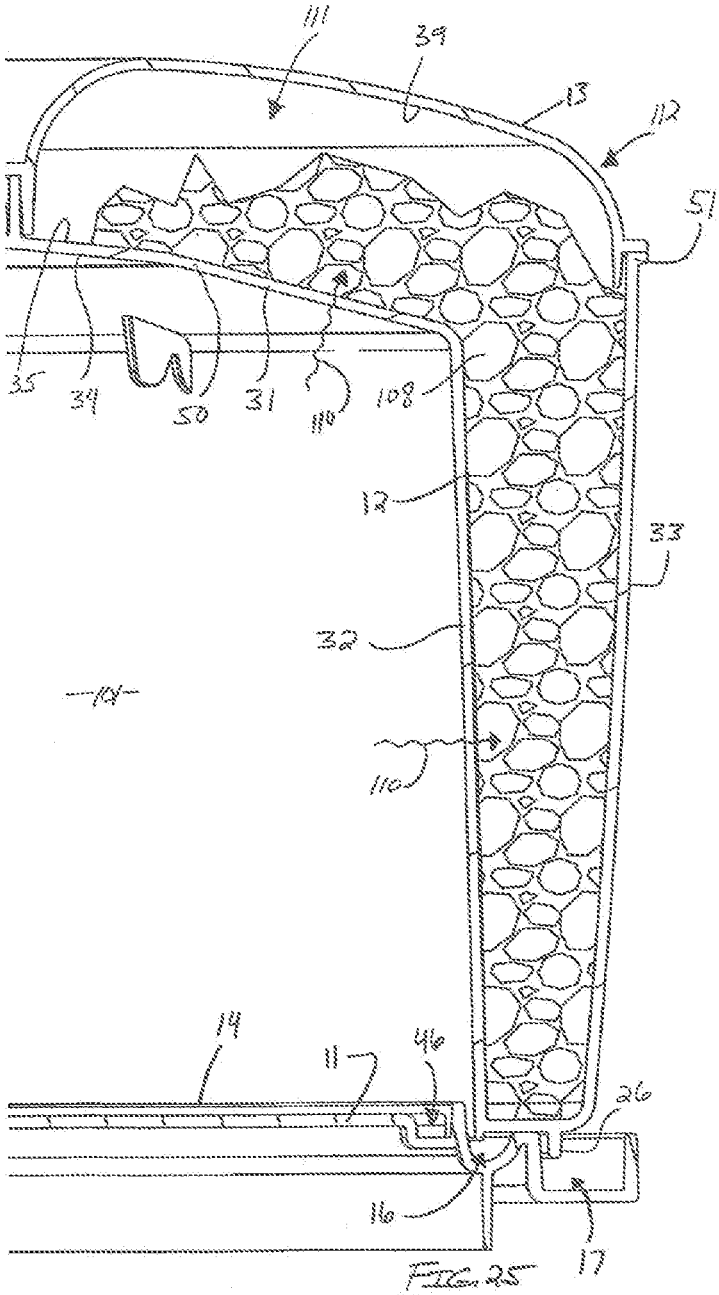
FIG. 25 is a fragmentary enlarged sectional view as sectioned from the right portion of the ice-filled outer medium-receiving space or compartment otherwise depicted in FIG. 24 to depict the surrounding structures in greater detail.
Figure 26:
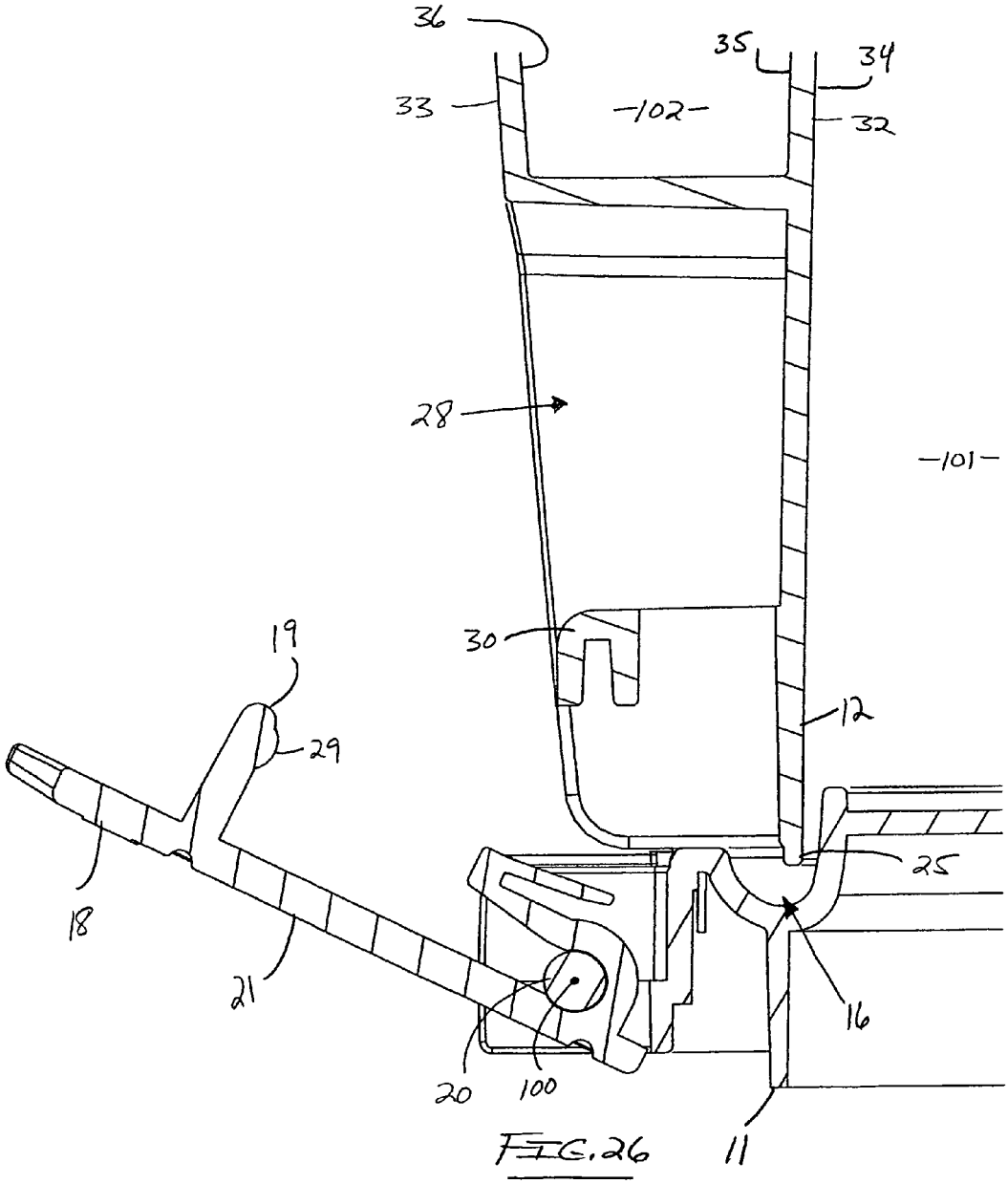
FIG. 26 is a fragmentary enlarged sectional view as sectioned from the lower left corner of FIG. 19 to depict the surrounding structures in greater detail.
Figure 27:
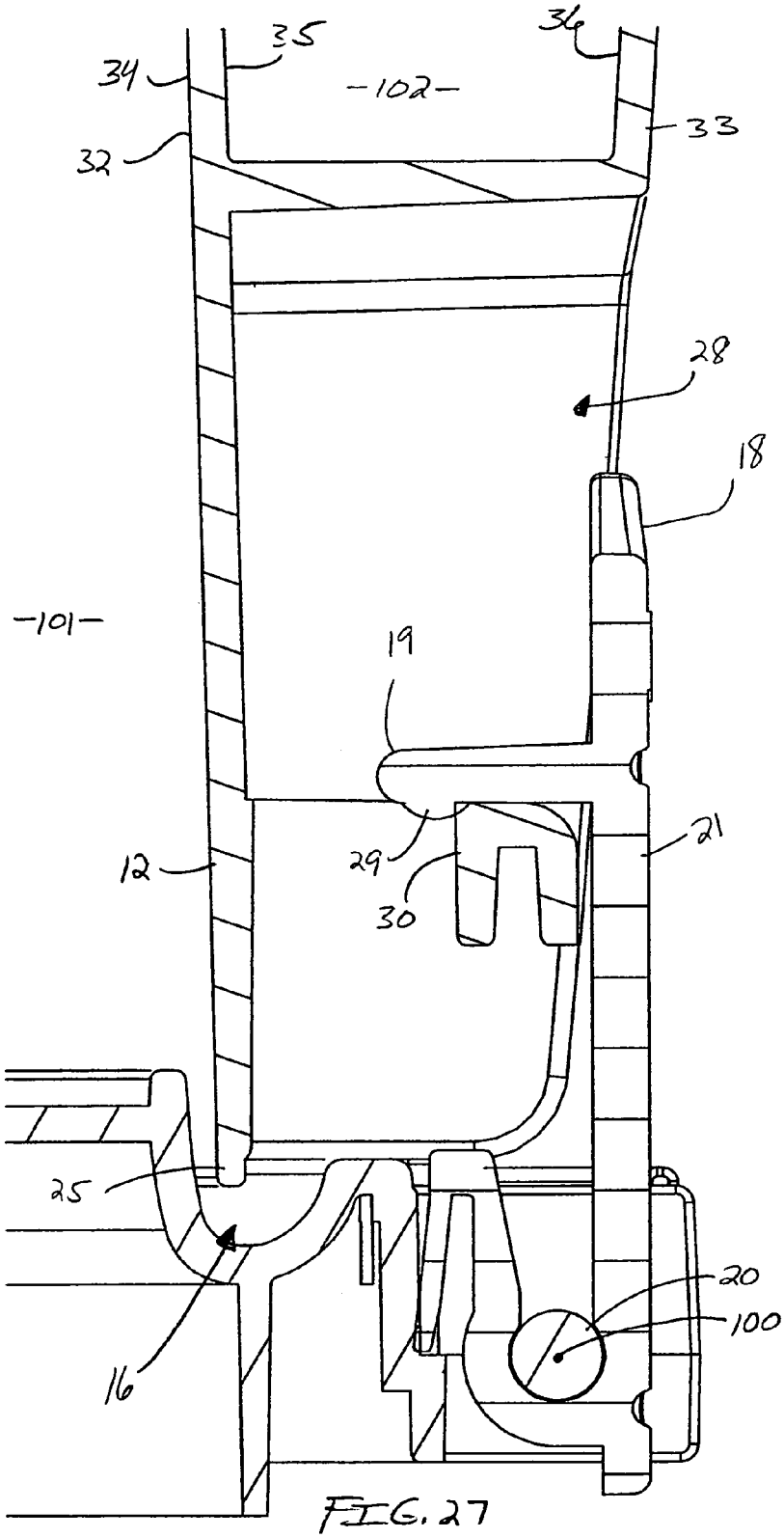
FIG. 27 is a fragmentary enlarged sectional view as sectioned from the lower right corner of FIG. 19 to depict the surrounding structures in greater detail.
Figure 28:
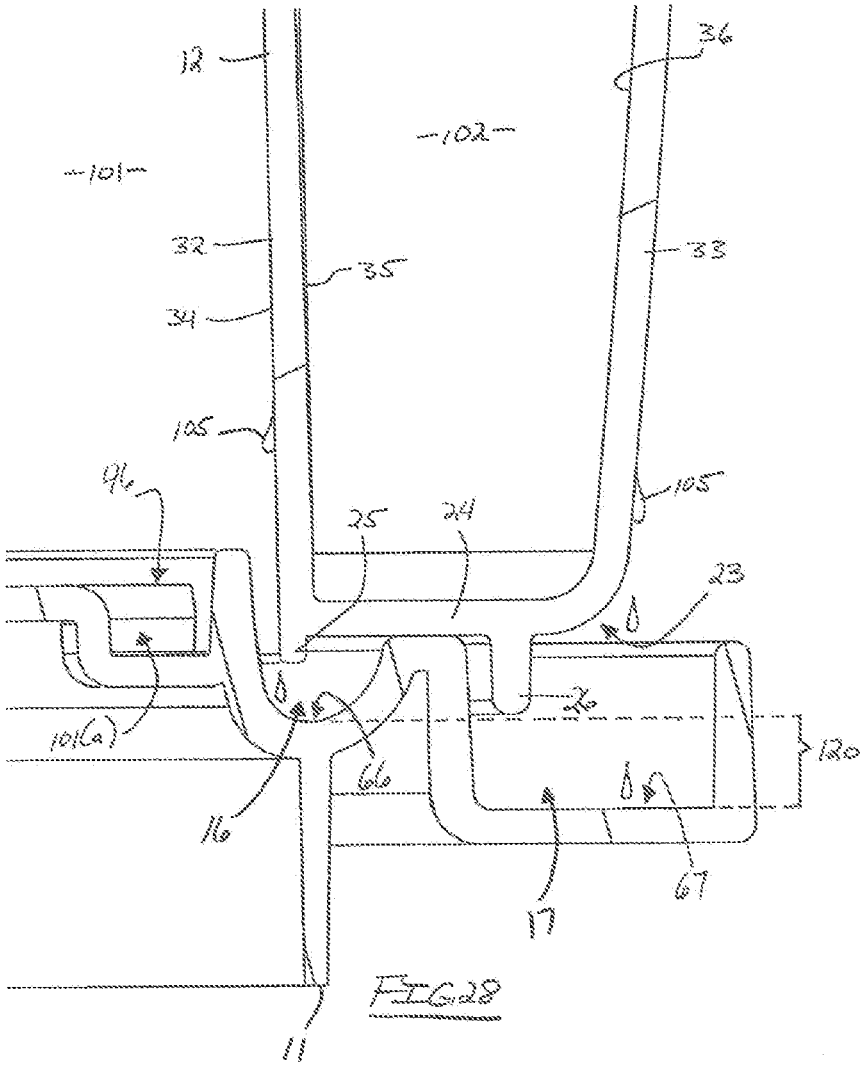
FIG. 28 is a fragmentary enlarged sectional view as sectioned from the lower right corner of FIG. 21 to depict the surrounding structures in greater detail.
Figure 29:
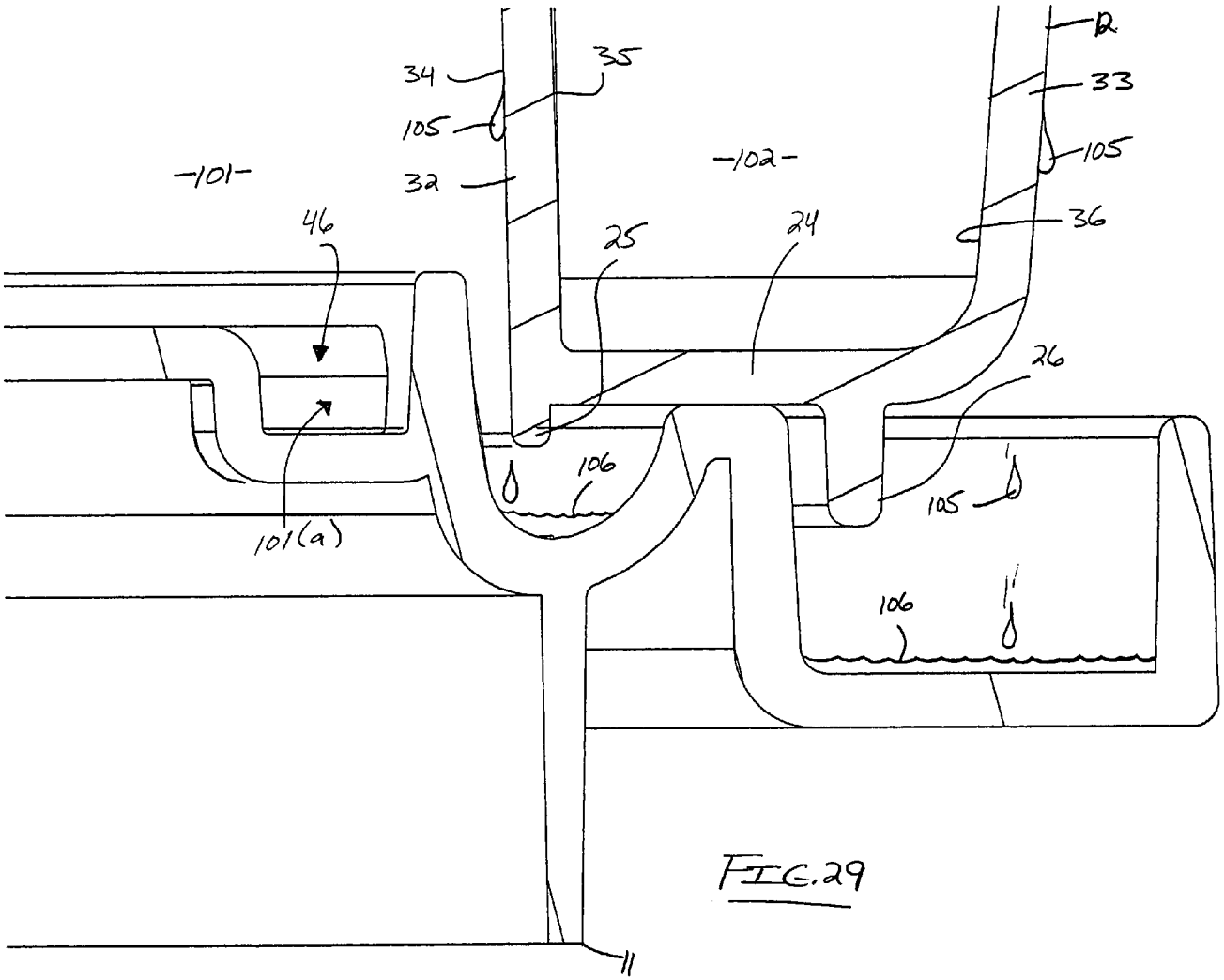
FIG. 29 is a fragmentary enlarged sectional view as sectioned from FIG. 28 to depict the junction site between the shroud structure and primary tray structure in still greater detail.
Figure 30:
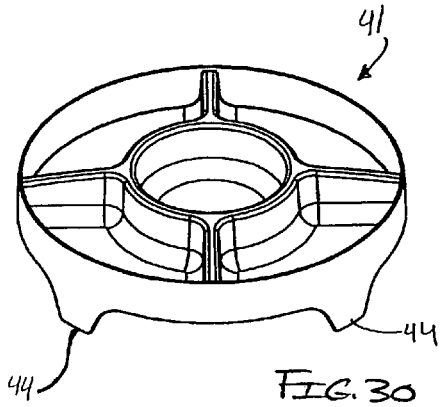
FIG. 30 is a top perspective view of a first secondary tray structure for secondarily compartmentalizing foodstuffs.
Figure 31:
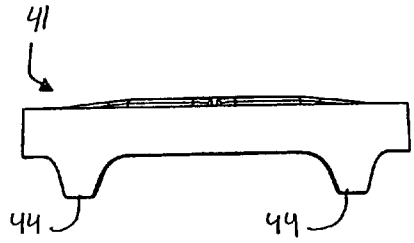
FIG. 31 is a side elevational view of the first secondary tray structure otherwise depicted in FIG. 30 showing two downwardly extending, circumferentially spaced tray feet.
Figure 32:
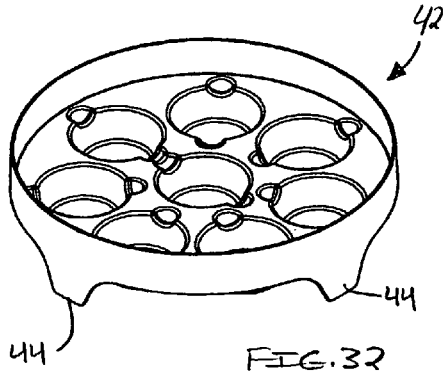
FIG. 32 is a top perspective view of a second secondary tray structure for secondarily compartmentalizing foodstuffs.
Figure 33:
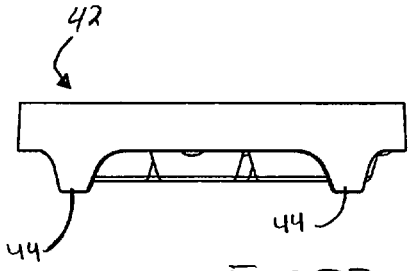
FIG. 33 is a side elevational view of the third secondary tray structure otherwise depicted in FIG. 32 showing two downwardly extending, circumferentially spaced tray feet.
Figure 34:
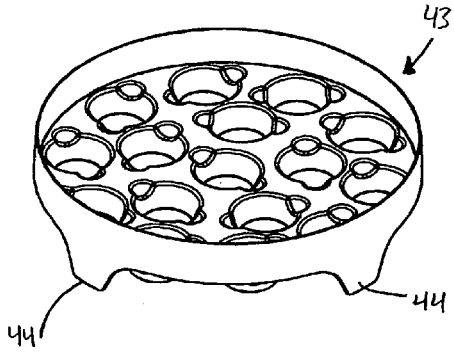
FIG. 34 is a top perspective view of a third secondary tray structure for secondarily compartmentalizing foodstuffs.
Figure 35:
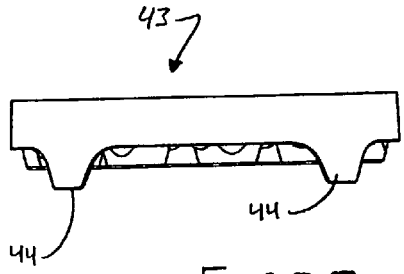
FIG. 35 is a side elevational view of the second secondary tray structure otherwise depicted in FIG. 35 showing two downwardly extending, circumferentially spaced tray feet.

The outer cover surface 35 of the inner cover portion 22 has a medium support portion as at 50 and the inner wall surface 36 of the outer section 33 has an upper terminus as at 51. The medium support portion 50 preferably has a lesser structural distance from the concentric ridges 25 and 26 or bottom portion 24 than the upper terminus 51. In other words, the portion 50 has a reduced structural height relative to the upper terminus 51 such that the medium support portion 50 may thus support the received and positioned heat transfer medium (e.g. ice 108) inwardly of the upper terminus 51 in superior adjacency to the matter-receiving space 101 as generally depicted in FIGS. 24 and 25. Further, the inner cover surface 34 is preferably sloped opposite the medium support portion 50 for maximizing the matter-receiving space 101.

The secondary tray structures 41, 42, and 43 may preferably be stacked, and each comprises a series of tray feet as at 44. The tray feet 44 are preferably received in a series of matter-receiving depressions 46 formed in the support platform portion 14. The matter-receiving depression 46 thus essentially function to receive matter such as the tray feet 44 in secondary matter-receiving space(s) 101(*a*) extending downwardly relative to the primary matter-receiving space 101.

While the foregoing specifications set forth much specificity, the same should not be construed as setting forth limits to the invention but rather as setting forth certain preferred embodiments and features. For example, as prefaced hereinabove, it is contemplated that the present invention essentially provides an apparatus for carrying and storing foodstuffs in a desired ambient temperature, which apparatus essentially comprises a primary tray structure; a shroud structure, a lid structure, and certain fastening means as heretofore exemplified.

The primary tray structure comprises an inner support platform portion and an outer shroud-receiving portion, the outer shroud-receiving portion comprising at least one ridge-receiving groove. The shroud structure comprises an inner cover portion, and an outer wall portion contiguous with the inner cover portion. The inner cover portion has an inner cover surface and an outer cover surface. The inner cover surface defines a matter-receiving space for covering matter supported by the support platform.

The outer wall portion of the shroud structure has an inner wall surface. Together, the contiguous outer cover surface and the inner wall surface define a medium-receiving space for receiving and positioning a heat transfer medium such as ice adjacent the matter-receiving space. The outer wall portion has a downwardly extending ridge, which ridge is insertable into the groove of the tray structure.

The lid structure is seatable upon the shroud structure for covering the medium-receiving space and the fastening means function to removably fasten the primary tray structure to the shroud structure. A heat transfer medium is receivable in the medium-receiving space for effecting heat transfer intermediate the medium-receiving and matter-receiving spaces for maintaining matter received within the matter-receiving space in a desired ambient temperature.

Stated another way, the apparatus according to the present invention essentially functions to carry and store foodstuffs in a desired ambient temperature, and comprises a primary tray structure; a shroud structure, a lid structure, and certain fastening means for selectively or removably fastening the tray structure to the shroud structure. The primary tray structure comprises an inner support platform portion and an outer shroud-receiving portion.

The shroud structure comprises a W-shaped longitudinal cross-section, which W-shaped longitudinal cross-section comprises an upwardly open medium-receiving space positioned about a downwardly open matter-receiving space. The medium-receiving space receives and positions a heat transfer medium in adjacency to the matter-receiving space. The lid structure is seatable upon the shroud structure for covering the medium-receiving space in which is received a heat transfer medium for effecting heat transfer intermediate the medium-receiving and matter-receiving spaces for maintaining matter received in the matter-receiving space in a desired ambient temperature.

Notably, heat transfer always occurs from a region of high temperature to another region of lower temperature, as required by law(s) of thermodynamics and thus heat transfer may be either into or out of the matter-receiving space depending on the relative temperature of the heat transfer medium as compared to the temperature of the matter received in or otherwise in equilibrium with the matter-receiving space.

Although the tray-to-shroud fastening means have been exemplified by the preferred embodiments set forth herein (as represented by tabs 18 having male protrusions 19 pivotable about pivot bars 20 having pivot axes 100 substantially tangent (as at 107) to portions of the outer groove 17, which male protrusions are insertable into the female structure(s) 28 and held thereby via the lips 29 as retained by lip-retaining structures 30), other fastening means such as shroud-to-tray fastening means as well as a general reversal of male and female structures for fastening the shroud structure to the tray structure or for fastening the tray structure to the shroud structure. In other words, it is contemplated that elements that are to be removably fastened to one another may be so fastened by way of virtually hundreds of different types of fastening means and thus an exhaustive listing of exemplary fastening means would be inappropriate for the purpose of these specifications.

Further, the apparatus 10 has generally been illustrated as circular in overall transverse cross-section. The transverse cross-section of apparatus 10 may not be so limited, however. For example, it is contemplated that the apparatus may be rectangular in overall construction for receiving rectangular or square foodstuffs, trays, or similar other matter.

Additionally, it is contemplated that the lid structure may be other than annular in overall construction, it being contemplated that its primary function is to cover the medium-receiving space for closing the heat sourcing compartment. In this last regard, it is contemplated that some medium, whether relatively hot or relative cold in temperature as compared to the matter-receiving space, when received in the heat sourcing compartment drives heat energy transfer according to the laws of thermodynamics. The lid structure, closes the compartment and thus helps maintain the heat transfer sourcing temperature inside the compartment.

Preferably, the handle structure extends upwardly through the annular aperture of the lid structure so as to enable the user to direct apparatus lifting forces centrally relative to the apparatus 10. Conceivably, handles or other manual gripping means could be outfitted and laterally extended from, or depressed into the shroud structure for providing gripping means. Without any handle structure or gripping means, the entire apparatus could conceivably be carried by supporting the tray structure with certain support structure such as one's hands.

Accordingly, although the invention has been described by reference to certain preferred embodiments, it is not intended that the novel arrangements be limited thereby, but that modifications thereof are intended to be included as falling within the broad scope and spirit of the foregoing disclosures and the appended drawings.

I claim:

1. An apparatus for carrying and storing matter in a desired ambient temperature, the apparatus comprising:

a circular primary tray structure, the circular primary tray structure comprising a circular inner support platform portion and a circular outer shroud-receiving portion, the circular inner support platform portion having a support surface and a peripherally-located matter-receiving depression, the support surface being at a first elevation, the matter-receiving depression being at a second elevation lower than the first elevation, the circular outer shroud-receiving portion having a peripherally-located, dual-groove, shroud-junction construction, the peripherally-located, dual-groove, shroud-junction construction being in radially outer adjacency to the matter-receiving depression and having a circular, radially inner groove and a circular, radially outer groove, the radially inner groove having an inner groove trough and the radially outer groove having an outer groove trough, the inner groove trough being at a third elevation and the outer groove trough being at a fourth elevation, the third elevation being lower than the second elevation and the fourth elevation being lower than the third elevation, the (1) matter-receiving depression, (2) inner groove trough and (3) outer groove trough thus forming a stepped, peripherally-located, series of platform-based depressions relative to the first elevation of the support surface;

a circular shroud structure, the circular shroud structure comprising an inner cover portion, and an outer wall portion contiguous with the inner cover portion, the inner cover portion defining a primary matter-receiving space for covering matter supported by the support platform portion, the outer wall portion and the inner cover portion defining a medium-receiving space, the medium-receiving space for receiving and positioning a heat transfer medium adjacent the primary matter-receiving space, the primary matter-receiving space being separated from the medium-receiving space via the inner cover portion, the outer wall portion having a peripherally-located, dual-ridge, platform junction construction, the peripherally-located, dual-ridge, platform-junction construction having a circular, radially inner ridge and a circular, radially outer ridge at a bottom portion thereof, the radially inner ridge being elevated relative to the radially outer ridge, the radially inner and outer groove troughs for respectively receiving the radially inner and outer ridges;

a lid structure, the lid structure being seatable upon the shroud structure for covering the medium-receiving space; and fastening means for removably fastening the primary tray structure to the shroud structure, a heat transfer medium being receivable in the medium-receiving space for effecting heat transfer intermediate the medium-receiving and primary matter-receiving spaces for maintaining matter received within the primary matter-receiving space in a desired ambient temperature.

2. The apparatus of claim 1 wherein the inner cover portion comprises an upwardly extending handle, the upwardly extending handle for enabling a user to carry the shroud structure.

3. The apparatus of claim 2 wherein the lid structure is annular, the upwardly extending handle being extendable through the annular lid structure for enabling the user to simultaneously carry the lid and shroud structures.

4. The apparatus of claim 1 wherein the inner cover portion comprises a medium support portion and the outer wall portion comprises an upper terminus, the medium support portion having a lesser structural distance from the radially inner and outer ridges than the upper terminus, the medium support portion thus for supporting a received and positioned heat transfer medium inwardly of the upper terminus in superior adjacency to the primary matter-receiving space.

5. The apparatus of claim 4 wherein the inner cover portion is sloped at the medium support portion, the sloped inner cover portion for maximizing the primary matter-receiving space.

6. The apparatus of claim 1 wherein the lid structure, outer wall portion, and inner cover portion together define a heat transfer sourcing compartment, the sourcing compartment having a longitudinal cross-section, the longitudinal cross-section of the sourcing compartment comprising opposed inverted L-shaped portions for maximizing the heat transfer area surrounding the primary matter-receiving space.

7. The apparatus of claim 1 wherein the fastening means interconnect the radially outer groove trough of the peripherally-located, dual-groove, shroud-junction construction to the outer wall portion, the outer wall portion thus for bearing a load inherent to the primary tray structure and matter-received thereupon via the fastening means.

8. The apparatus of claim 7 wherein the fastening means comprise a series of pivotable male structures pivotable about pivot axes tangent to portions of the radially outer groove trough of the peripherally-located, dual-groove, shroud-junction construction, the shroud structure at the outer wall portion comprising a series of female structures, the female structures for simultaneously receiving and concealing the male structures when the fastening means fasten the primary tray structure to the shroud structure.

9. The apparatus of claim 1 comprising at least one secondary tray structure, the secondary tray structure for supporting foodstuffs in superior adjacency to the primary tray structure, the secondary tray structure comprising at least one tray foot, at least one tray foot being receivable by the matter-receiving depression for positioning the secondary tray structure relative to the primary tray structure.

10. An apparatus for carrying and storing matter in a desired ambient temperature, the apparatus comprising:

a primary tray structure, the primary tray structure comprising an inner support platform portion and an outer shroud-opposing portion, the inner support platform portion having a support surface and a peripherally-located matter-receiving depression, the support surface being at a first elevation, the matter-receiving depression being at a second elevation lower than the first elevation, the outer shroud-opposing portion having a peripherally-located dual-groove, shroud-junction construction, the peripherally-located, dual-groove, shroud junction construction being in radially outer adjacency to the matter-receiving depression and having an inner groove and an outer groove, the inner and outer grooves being concentric, the inner groove having an inner groove trough and the outer groove having an outer groove trough, the inner groove trough being at a third elevation and the outer groove trough being at a fourth elevation, the third elevation being lower than the second elevation and the fourth elevation being lower than the third elevation, the (1) matter-receiving depression, (2) inner groove trough and (3) outer groove trough thus forming a stepped, peripherally-located, series of platform-based depressions relative to the first elevation of the support surface;

a shroud structure, the shroud structure comprising an inner cover portion, and an outer wall portion contiguous with the inner cover portion, the inner cover defining a primary matter-receiving space for covering matter supported by the support platform portion, the outer wall portion and the inner cover portion defining a medium-receiving space, the medium-receiving space for receiving and positioning a heat transfer medium adjacent the primary matter-receiving space, the outer wall portion having a peripherally-located, dual-ridge, platform junction construction, the peripherally-located, dual-ridge, platform-junction construction having an inner ridge and an outer ridge, the inner and outer ridges being concentric, the inner ridge being elevated relative to the outer ridge, the inner and outer groove troughs for respectively receiving the inner and outer ridges;

a lid structure, the lid structure being seatable upon the shroud structure for covering the medium-receiving space; and fastening means for removably fastening the primary tray structure to the shroud structure, a heat transfer medium being receivable in the medium-receiving space for effecting heat transfer intermediate the medium-receiving and primary matter-receiving spaces for maintaining matter received within the primary matter-receiving space in a desired ambient temperature.

11. The apparatus of claim 10 wherein the inner cover portion comprises an upwardly extending handle, the upwardly extending handle for enabling a user to carry the shroud structure.

12. The apparatus of claim 11 wherein the lid structure is annular, the upwardly extending handle being extendable through the annular lid structure for enabling the user to simultaneously carry the lid and shroud structures.

13. The apparatus of claim 10 wherein the inner cover portion comprises a medium support portion and the outer wall portion comprises an upper terminus, the medium support portion being lesser in height relative to the upper terminus, the medium support portion thus for supporting a received and positioned heat transfer medium inwardly of the upper terminus in superior adjacency to the primary matter-receiving space.

14. The apparatus of claim 10 wherein the lid structure, outer wall portion, and the inner cover portion together define a heat transfer sourcing compartment, the sourcing compartment having a longitudinal cross-section, the longitudinal cross-section of the sourcing compartment comprising opposed inverted L-shaped portions for maximizing the heat transfer area surrounding the primary matter-receiving space.

15. The apparatus of claim 10 wherein the fastening means interconnect the tray structure to the outer wall portion, the outer wall portion thus for bearing a load inherent to the primary tray structure and matter-received thereupon via the fastening means.

16. The apparatus of claim 15 wherein the fastening means comprises a series of pivotable male structures pivotable about pivot axes tangent to portions of the outer shroud-opposing portion, the shroud structure at the outer wall portion comprising a series of female structures, the female structures for simultaneously receiving and concealing the male structures when the fastening means fasten the primary tray structure to the shroud structure.

17. The apparatus of claim 10 comprising at least one secondary tray structure, the secondary tray structure for supporting foodstuffs in superior adjacency to the primary tray structure, the secondary tray structure comprising at least one tray foot, at least one tray foot being receivable by the matter-receiving depression for positioning the secondary tray structure relative to the primary tray structure.

18. An apparatus for carrying and storing matter in a desired ambient temperature, the apparatus comprising:

a primary tray structure, the primary tray structure comprising an inner support platform portion and an outer shroud-opposing portion, the inner support platform portion having a support surface and a peripherally-located matter-receiving depression, the support surface being at a first elevation, the matter-receiving depression being at a second elevation lower than the first elevation, the outer shroud-opposing portion having a peripherally-located, dual-groove, shroud junction construction, the peripherally-located, dual-groove, shroud junction construction being in radially outer adjacency to the matter-receiving depression and having an inner groove and an outer groove, the inner and outer grooves being concentric, the inner groove having an inner groove trough and the outer groove having an outer groove trough, the inner groove trough having a differing elevation relative to the outer groove trough, the matter-receiving depression, inner groove trough and outer groove trough forming a stepped, peripherally-located, series of platform-based depressions relative to the first elevation of the support surface;

a shroud structure, the shroud structure comprising an upwardly open medium-receiving space, a downwardly open matter-receiving space, a peripherally-located, dual-ridge, platform junction construction, the peripherally-located, dual-ridge, platform-junction construction having a downwardly extending inner ridge and a downwardly extending outer ridge, the upwardly open medium-receiving space being positioned about the downwardly open matter-receiving space, the medium-receiving space for receiving and positioning a heat transfer medium in adjacency to the matter-receiving space, the inner and outer ridges being concentric, the inner ridge having a differing elevation relative to the outer ridge, the inner and outer grooves for respectively receiving the inner and outer ridges;

a lid structure, the lid structure being seatable upon the shroud structure for covering the medium-receiving space; and fastening means for removably fastening the primary tray structure to the shroud structure at the shroud-opposing portion, a heat transfer medium being receivable in the medium-receiving space for effecting heat transfer intermediate the medium-receiving and matter-receiving spaces for maintaining matter received within the matter-receiving space in a desired ambient temperature.

* * * * *